United States Patent [19]

Sims, Jr.

[11] 3,969,600

[45] July 13, 1976

[54] TACTILE FEEDBACK KEYBOARD SWITCH ASSEMBLY AND ACTUATOR

[75] Inventor: Dewey M. Sims, Jr., Westland, Mich.

[73] Assignee: Burroughs Corporation, Detroit, Mich.

[22] Filed: June 11, 1975

[21] Appl. No.: 586,039

[52] U.S. Cl. ..... 200/159 B; 200/5 A; 200/340

[51] Int. Cl.[2] ..... H01H 13/14; H01H 3/17

[58] Field of Search ..... 200/5 R, 5 A, 159 R, 200/159 A, 159 B, 329, 340

[56] References Cited

UNITED STATES PATENTS

| | | | |
|---|---|---|---|
| 3,582,594 | 6/1971 | Twyford | 200/340 |
| 3,668,356 | 6/1972 | Kekas | 200/340 X |
| 3,829,646 | 8/1974 | Lorteije et al. | 200/340 |
| 3,856,998 | 12/1974 | Sims, Jr. | 200/340 X |

*Primary Examiner*—James R. Scott
*Attorney, Agent, or Firm*—Ronald L. Taylor; Edwin W. Uren; Kevin R. Peterson

[57] ABSTRACT

The disclosure relates generally to key assemblies employed in electrical switch operating keyboard devices and more particularly to the improved assembly of parts forming an individual depressible key on such a keyboard. Each key assembly is comprised of parts cooperatively interfitting to provide both audio and tactile feedback for the keyboard as well as a bifurcated electrical contact provision. Included in each key assembly is a spring having a buckling beam member with two end supports that will resist a key depression, a hermetic rubber pad that will also resist key depression and a pair of spring straddling members depending from the key assembly for conveying forces employed to depress the key to the switch associated with the assembly to effect closure of the same as well as for substantially reducing if not eliminating a detrimental contact bounce encountered in the operation of such assemblies. The force transmitting pair of depending members cooperate with the straddle spring to provide a rocker or teetering motion in conjunction with the desired bifurcated action for assuring closure of the contacts.

22 Claims, 9 Drawing Figures

TACTILE FEEDBACK KEYBOARD SWITCH ASSEMBLY AND ACTUATOR

CROSS REFERENCE TO RELATED PATENTS

A patent entitled "Keyboard Switch Assembly With Improved Operating Means" bearing U.S. Pat. No. 3,856,998 was granted on Dec. 24, 1974 to Dewey M. Sims, Jr. and describes key assemblies employed in electrical switch operating keyboard devices. The present invention is an improvement thereon and is assigned to the same assignee as the above-indicated patent.

BACKGROUND OF THE INVENTION

This invention is directed to switch actuating keyboards and more particularly to the structure of the individual keys thereof for closing associated electrical switches.

SUMMARY OF THE INVENTION

An object of this invention is to provide an improved key assembly for switch actuating keyboards which is designed for reliable, long-life usage.

Another object of this invention is to provide an improved switch-actuating key-operated assembly which eliminates premature electrical contact as well as helping to reduce the severity of vibration transmissability occurring at the switch.

Another object of the invention is to provide a spring that resists key depression and has a beam that buckles at a predetermined point to give tactile and audio feedback of switch closure.

Still another object of the invention is to provide a rubber-like pad for hermetically sealing-off the switch contacts.

Another object of the invention is to provide a rubber-like pad that will cooperate with the spring to eliminate bounce of the electrical contacts.

A further object of the invention is to provide an improved key assembly having means for insuring an effective switch closure even for off-center depressions.

More specifically the objects of the present invention are effectively and economically carried out with the cooperation of the parts forming the key assembly in conjunction with certain diaphragms carrying conductive elements thereon to form the electrical switch for the actuatable parts of the key. Included in such a key mechanism are a buckle spring and a pair of extension members depending from the key itself to straddle the buckle spring, all of which are related to each other in such a way that the buckle spring acts to resist depression of the key while the pair of depending extension members acts to transmit the actuating key force for closing electrical contacts serving as a switch. For timing the closure of the switch in the operation of the key assembly as well as to improve the tactile feel thereof, the depression resisting buckle spring is especially designed so as to have two distinctive spring rates as it is depressed, a high pre-buckle and a low post-buckle rate. A rubber-like pad is additionally provided to hermetically seal-off the switch contacts in order to protect them from dust and oxidation. The pad also serves as a very high spring rate spring analogue that cooperates with the low post-buckle spring rate near the end of the key depression to eliminate contact bounce. The under surface of the key assembly and the ends of the key extension depending members are shaped to provide a reliable switch closure even for off-center depressions.

The above listed objects, advantages and other meritorious aspects of the invention will be more fully explained in the following detailed description. For more complete understanding of the invention, reference may be had to the following detailed description in conjunction with the accompanying drawings and appended claims.

DESCRIPTION OF THE PREFERRED EMBODIMENT

Figure 1:
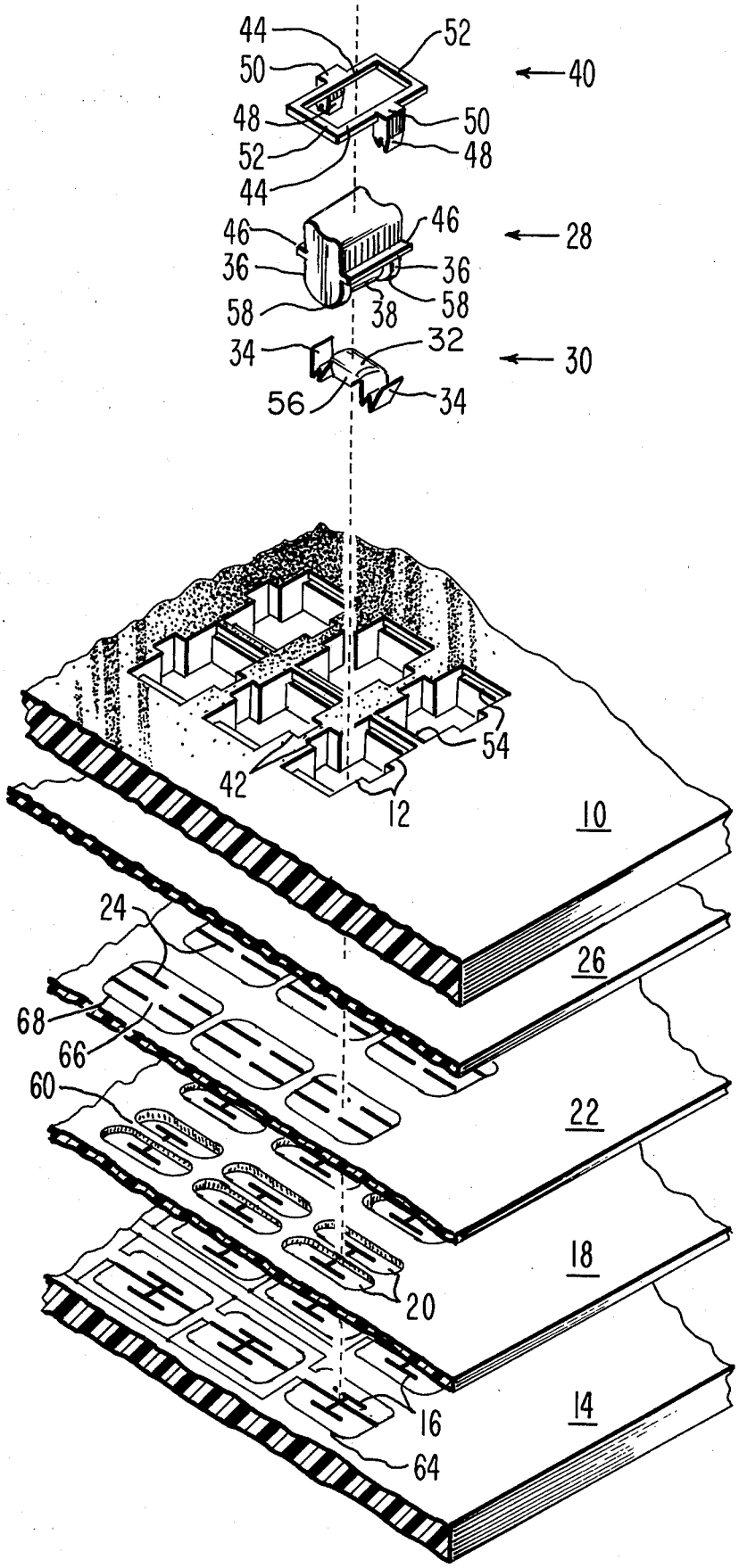
FIG. 1 is an exploded perspective view of a fragmentary portion of keyboard showing the parts of one of the key assemblies in their order of assembly.

Referring to the drawings, a fragmentary portion of a keyboard incorporating the present invention is generally designated in an exploded perspective condition in FIG. 1. In general the top member 10 of the keyboard may be formed of hardened plastic material molded so as to provide a plurality of key assembly holding apertures 12 which may be arranged in crossing rows and columns in accordance with conventional practice. At the bottom end of the keyboard is a base member 14 which may either be a printed circuit board 14 formed of molded plastic material and bearing connecting elements 16 on its upper surface or a metal plate 14 overlapped by a thin sheet of electrically insulating material bearing electrically conductive elements 16 on the upper surface thereof so as to be insulated from the metal base 14. Interposed between the base plate 14 and the top member 10 of the keyboard are the plurality of keyboard systems or key actuatable assemblies, one for each key of the keyboard for individually closing and opening a switch associated with the conductive electrical elements 16 carried by the base member 14. In general, the keyboard of the present invention is structured to include a number of layers as will be described infra between these two members 10 and 14 and which are shown in FIG. 1 in their order of assembly.

With more specific reference to FIGS. 1, 2 and 3 the layer immediately above the base member 14 is a dielectric 18 serving as a thin electrical separator between adjacent layers and having cut-outs or apertures 20 formed therein which are grouped together in pairs with one pair for each key assembly as will be described in more detail hereinafter. Immediately above the dielectric member 18 is a diaphragm 22 of insulating material carrying conductive leads 24 on its under surface which are likewise paired for each key assembly as will be later described herein. Immediately superimposing the diaphragm 22 is a cover member or pad 26 which may be formed of rubber or rubber-like material and serves to hermetically seal the electrical conductive elements and further serves as a thin deflectable pad having a high spring rate as will be more fully described hereinafter.

Figure 2:
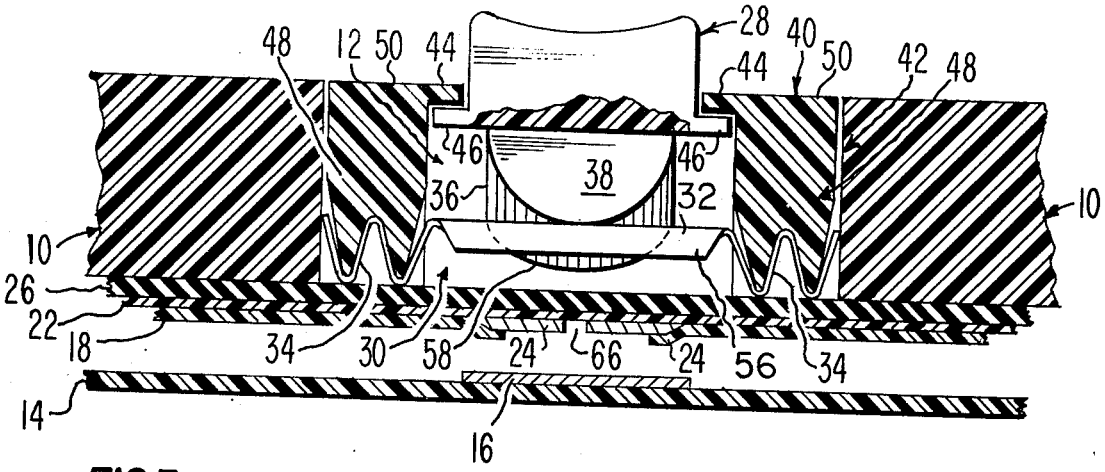
FIG. 2 is an enlarged vertical sectional view through a key switch assembly constructed in accordance with this invention showing the parts of the assembly in its normal undepressed condition.
Figure 3:
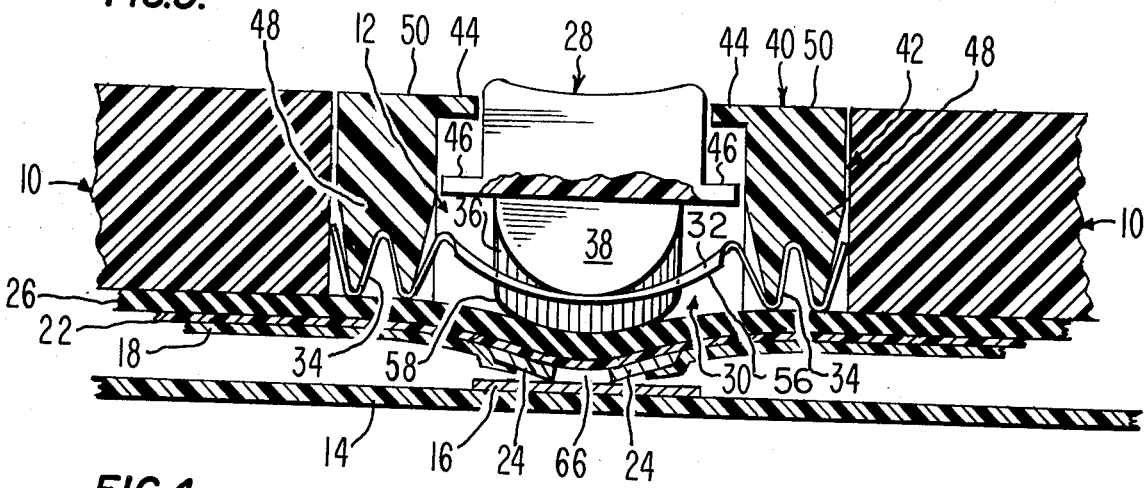
FIG. 3 is an enlarged vertical sectional view similar to that of FIG. 2 but illustrating the parts of the assembly in its depressed condition.
Figure 4:
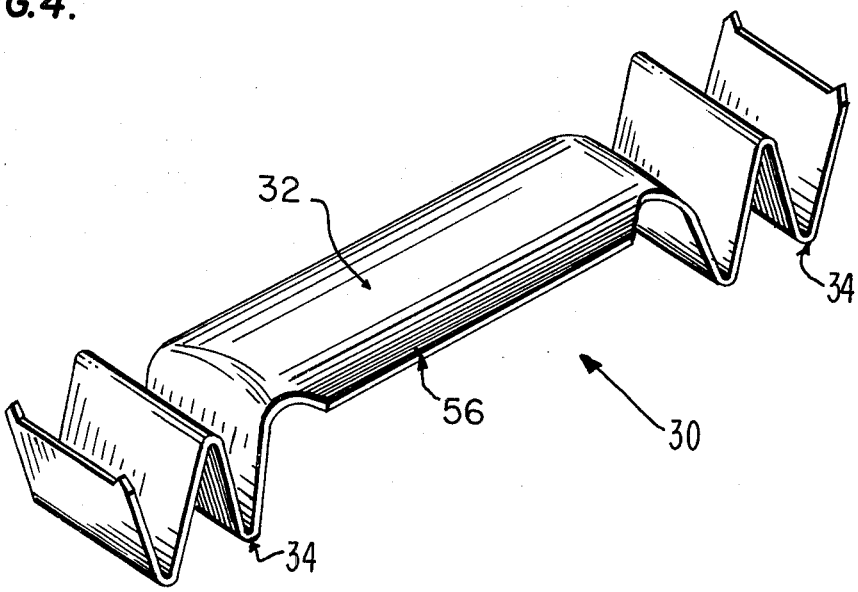
FIG. 4 is an enlarged detailed view of the buckle spring employed as a force resisting member while the switch is being activated.

With further reference to FIGS. 1, 2 and 3 the key assembly comprises a keytop 28 which travels down or up in the before-mentioned aperture 12 in response to downward force supplied to the keytop 28 itself or upward force applied by a yieldingly resistive spring 30 which buckles when force is applied. The buckle spring 30 itself, as shown in FIG. 4, comprises a beam member 32 and abutment legs 34 at each end for support. The keytop 28 has a pair of depending members 36 disposed on the underside of the keytop 28 and straddling the buckle spring 30 in such a way as to apply pressure to the rubber-like pad 26 when the keytop 28 is depressed. The keytop 28 interacts with the buckle spring 30 itself through a cam-like surface 38 depending or extending down from the keytop 28 and disposed between the pair of depending members 36. The cam-like surface acts to depress the buckle spring 30 over-center even when force is applied to the keytop 28 off-center.

Limiting the upward travel of the keytop 28 in its aperture 12 in response to the resisting buckle spring 30 are a pair of plug-like members 40 sitting in their own apertures 42 adjacent the keytop aperture 12 and each having an overhanging stop 44 on opposite sides of the keytop aperture 12 which interact with a matching flared-out stop 46 on corresponding opposite sides of the keytop member 28 to limit such upward travel. The aforementioned end abutment legs 34 of the buckle spring 30 which sit in their own plug-like member apertures or side apertures 42 have been formed into the shape of a crimped W. Members 48 depending from the top portion 50 of the plug-like members 40 that sit in their respective apertures 42 are formed to conform to the inside dimensions of the W crimp 34 so as to restrain movement of the buckle spring 30 when said spring 30 is being manipulated. Particularly, the legs 34 of the spring 30 will function as supporting nodes when the spring's beam 32 is buckled. The oppositely disposed plug-like members 40 for each keytop aperture 12 may be interconnected by joining strips 52 set in shelf-like channels 54 formed in the top member 10 on either side of the keytop aperture 12. The pair of plugs 40 for each keytop 28 is the illustrated preferred embodiment, but alternatively each pair of plug-like members 40 also may be joined to other adjacent keys 28 so as to form row or column strips of the plug-like members 40 for ease of assembly.

With further reference to FIG. 4, the buckle spring operates on the same well known principle as a steel measure tape which buckles when pressure is applied over-center to its convex side. Particularly, the buckle spring 30 has convex side surfaces 56 along the longitudinal axis of the beam 32 as exposed to the pressure applying keytop cam-like surface 38. The beams 32 radius approaches infinity and its surface becomes substantially planar along its lateral axis as its buckle point is approached by applying over-center pressure through the keytop 28. When such buckling is effected, a tactile feedback may be sensed on the keytop 28 by the snapping action of the spring 30 as the beam 32 flattens out. Additionally an audio effect may be sensed by the same buckling. The illustrated preferred buckle springs are formed as discrete units but would alternatively be formed as a continuous row of units on a strip of wire having connecting strips of wire set in the plug-like members 40 connecting channels to link adjacent key positions thus again facilitating installation.

As mentioned earlier and as shown in FIG. 6, the keytop cam-like surface 38 for depressing the buckle spring 30 is operative to achieve over-center spring depressions even for off-center keytop 28 depressions. This is achieved by shaping the cam-like surface 38 like a limited arc roller whose axis is substantially perpendicular to the longitudinal axis of the beam 32. In effect, whenever force is applied off-center to the keytop 28, it will be redirected from the raised side of the cam-like surface 38 to an over-center position relative to the buckle spring 30 thus requiring a minimum pressure to buckle. The advantages of redirecting the keytop 28 depression force include a substantially minimal constant pressure depression requirement and a constant speed travel for the keytop 28 as it is alignably depressed into its aperture 12 even for extreme off-center keytop 28 depressions.

It will be noted that the buckle spring 30 and the rubber-like pad 26 acting together have a high initial spring rate mode, a transition mode, a low spring rate mode and a very high final spring rate mode. The spring has a high spring rate at the initial depression where it is resisting or is highly resistive to the pressure applied to the keytop 28 thus allowing downward movement only at a relatively high pressure. Once sufficient pressure has been applied to begin to buckle the spring, indicating definite tactile commitment, the spring 30 will go through a brief transition mode which exhibits characteristics analogous to a negative spring rate in which the beam 32 will briefly continue traveling downward expending stored energy. Once a given downward point in its travel has been reached by the beam 32 at the end of the buckling, the low spring rate mode will be entered. This mode is characterized by allowing a relatively large travel to be had by a relatively small applied pressure. As the keytop 28 nears the end of its depression and begins to contact the rubber-like pad 26 proximate to or just prior to contact closure, the mode characterized by the very high final spring rate of the rubber-like pad 26 cumulatively added to the low spring rate of the buckle spring 30 is entered. This results in the rubber-like pad 26 spring rate being effectively the only one affecting the downward travel of the keytop 28. During this mode, the very high spring rate will allow travel only upon a relatively very high applied pressure thus decelerating the rate of depression travel considerably.

The operational results of the above modes are that the high initial spring rate mode will preclude accidental tripping of the switch due to the initial high applied pressure requirements. The transition mode will give a definite perceptible tactile as well as a suitable audio indication once a commitment to switch closure has been made. The low spring rate mode assists in eliminating premature electrical contact by providing some resistance to depression travel. It also acts to reduce operator fatigue by virtue of the reduced tactile pressure requirement. The very high final spring rate mode insures electrical contact before the keytop 28 goes beyond a desired limit by severely limiting depression travel speed. Alternatively stated, the very high final spring rate helps to eliminate contact bounce by reducing the severity of transmission of any vibration occurring between the pair of depending members 36 and the contact bearing diaphragm 22 once they are proximate to each other.

Figure 5:
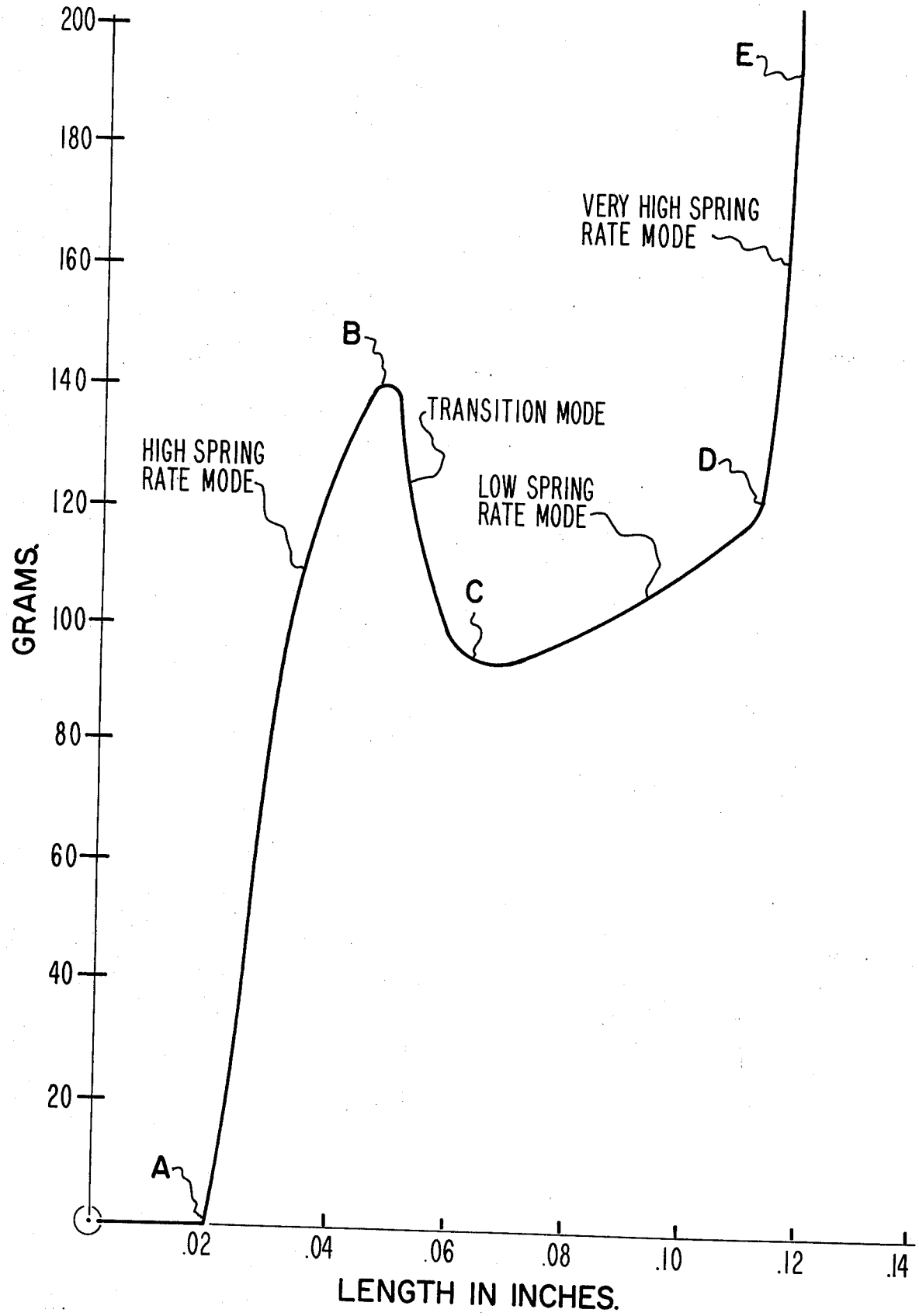
FIG. 5 is a force deflection graph illustrating the action of the buckle spring of FIG. 4.

The force deflection graph of FIG. 5 illustrates the combined action of the buckle spring 30 and the rubber-like pad 26. Initially, resistance to compression of the spring 30 is a relatively high spring rate as evidenced by the slopes of the graph between A and B. As the transition mode or buckle point is reached, the rate enters its negative analog as indicated by the downward slope of the graph between B and C. After this, a region having a relatively low spring rate is entered as shown on the graph between points C and D. Finally, the portion of the graph having a relatively very high final spring rate is activated on the graph between D and E. As mentioned supra, the portion between D and E is the sum of the buckle spring 30 and rubber-like pad 26 rates with the rubber-like pad 26 being predominant. At point E on the graph, the keytop 28 is at maximum depression and at rest until released.

Figure 6:
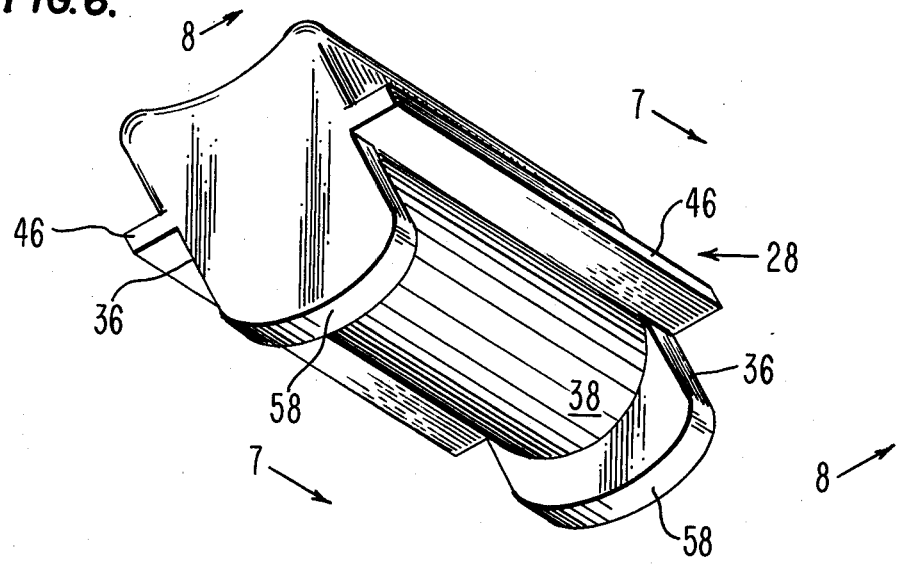
FIG. 6 is an enlarged detailed view of the under surface of the switch actuating depending key assembly extension members.

To gain the earlier mentioned bifurcated action, the underside of the keytop member 28 opposite each buckle spring 30 is provided as further shown in FIG. 6 and as mentioned supra with a pair of depending pressure applying elements 36 of similar rocker or half moon shapes. Such elements 36 are suspended from the underside of the keytop member 28 in spaced parallel relation to one another so as to straddle the buckle spring 30 along its longitudinal axis as shown in FIG. 1. Each element 36 preferably exhibits an arcuate lower edge 58 for engaging and depressing the rubber cover 26 making a curved or rocking chair-type contact therewith and moreover these elements 36 preferably form an integral part of the keytop member 28. By such an arrangement and formation, the two arcuate elements 36 correctly form a pressure applying double radius structure incorporating rocking ability analogous to the legs of the rocking chair.

In addition, the depending spring straddling rocker members 36 are operative to teeter from one rocking member 36 to the other depending on how pressure from the keytop 28 is applied by virtue of the flexure inherent in the sides of the beam member. This teetering of either side of the beam sides 32 constitute an axis extending substantially at 90° or right angles to the rocking axis of the arcuate elements 36. The result is that each keytop 28 is capable of rocking or teetering about either axis separately or both axes concurrently as downward pressure is applied on the keytop 28. It is evident that the keytop 28 is not only depressible in response to key actuation, but also is capable of rocking or teetering motion about either or both such axes. The desired bifurcated action is achieved by converting forces on the keytop 28 to two separated pressure applying areas through the depending members 36 in response to each depression of the keytop 28 while at the same time enabling the bifurcated end of the keytop 28 comprising the depending arcuate members 36 to teeter or rock about two perpendicularly related axes for assuring substantially continuous closure of the switch contacts.

Figure 9:
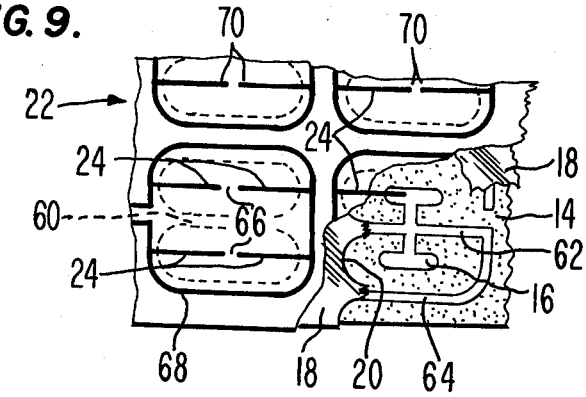
FIG. 9 is an enlarged detailed view of the conductor patterns forming the contacts.

The results of a key actuation is shown by comparing FIGS. 2 and 3 with one another. FIG. 2 shows a keytop 28 raised to its maximum level with the buckle spring 30 under no compression and thus not buckled. FIG. 3 shows the position of the parts when the buckle spring 30 has buckled, the rubber-like pad 26 has been deflected, and the keytop 28 has been fully depressed to its maximum extent. It is noted in FIG. 3 that the pair of depending members 36 have been depressed below their normal level shown in FIG. 2 to depress the rubber-like pad 26 and the diaphragm 22 underneath thus downwardly bringing the conductive leads 24 on the underside of diaphragm 22 into engagement with the conductive pads 16 on the base member 14 of the assembly. In so doing, the depending elements 36 are brought into alignment with the pair of parallel leads 24 on the underside of diaphragm 22 as shown in FIG. 9 and depressing them through the pair of oval apertures 20 of the dielectric 18 in alignment therewith and hence bringing these leads 24 into contact with the conductive pads 16 of the base member 14 which registers therewith. The intervening portion 60 of the dielectric 18 which separates the oval holes 20 provides independent deflection zones into which the two parallel leads 24 are introduced for engagement with the separated portions of the pad 16 located in the position of the actuated keytop 28. In effect, the intervening portion 60 of the dielectric 18 acts as a shim which is straddled by the bifurcated structure 36 and about which it may teeter or rock.

Figure 7:
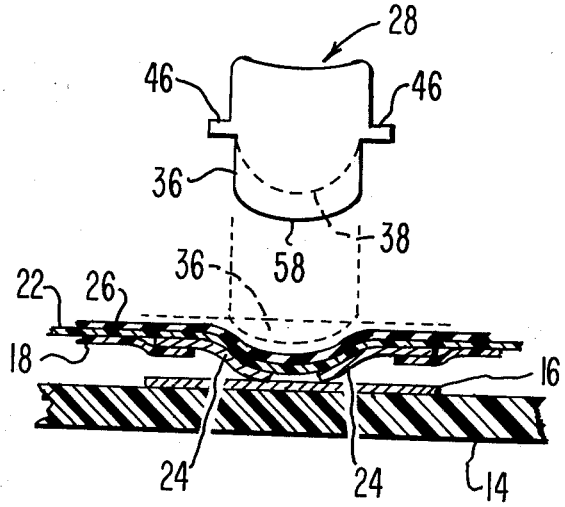
FIG. 7 is an enlarged detailed sectional view taken along line 7—7 of FIG. 6 and illustrating the action of one of the bifurcated elements.
Figure 8:
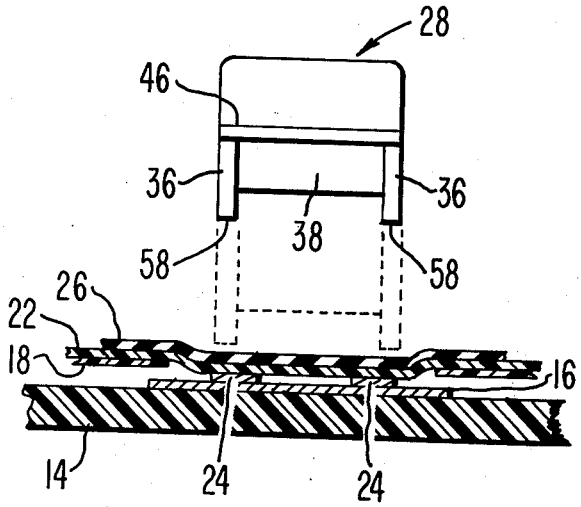
FIG. 8 is a sectional view similar to FIG. 7 but taken on along line 8—8 of FIG. 6.

FIGS. 7, 8 and 9 illustrate the action of making contact between the leads 24 of the flexible diaphragm 22 and the pads 16 for the base member 14. The conductive pattern on two laminates 22 and 14 may be that illustrated in FIG. 9 where in each key position of the keyboard the base member 14 is provided with a conductive pattern such as represented in the lower right hand corner of FIG. 9 comprising the two conductive areas or pads 16 joined by conductive leads 62 to a peripheral conductor 64 which in turn can be connected to one or more adjacent conductive patterns on the base member 14. Immediately superimposing the conductive pattern on the base member 14 is the earlier mentioned dielectric sheet 18 having a pair of generally oval-shaped cut-outs or apertures 20 in each key position which as shown in FIG. 9 will expose the pads 16 therethrough.

Above the dielectric 18 sheet is the diaphragm 22 which may bear the conductive pattern on the underside thereof illustrated in the lower left corner of FIG. 9. The diaphragm 22 is a preferably thin elastometric member which may be translucent rendering the pattern on the underside thereof visible therethrough as indicated in FIGS. 1 and 9. For purposes hereinafter discussed, each lead 24 is shown in FIGS. 1 and 9 as being interrupted or broken to form a gap 66 therein. These broken or split ends 24 are connected at their outer ends to a peripheral conductor 68 which preferably registers with and therefor overlies and bears upon the peripheral conductors 64 of the base member 14 through the intermediary of the insulating sheet 18. Thus during the depression of each keytop 28, the registering peripheral conductors 64 and 68 provide a bearing zone or frame surrounding the central area containing the pads 16 and the broken leads 24.

Another feature of the switch formed by the overlying conductor patterns is that provided by the division of each lead 24 into two aligned sections separated by the gap 66 and the provision of a radius of curvature identified at 70 on the gap end of each part of the divided lead. Referencing to FIG. 7, it will be apparent that when the bifurcated pressure element 36 of each keytop depresses the laminates 22 and 26 through the holes 20 of the dielectric sheet 18 as shown in FIGS. 7 and 8, they will bow the gap portions of the leads 24. Moreover, because of the bowing of the split sections of each lead 24, the initial contact made by such lead with its pad 16 is a point of high pressure which is later spread over more surface area of the leads as the key assembly is further depressed. The curving of the ends of the split parts of each lead 24 at the gap 66 assures that the first contact with the pad 16 of the base member is a point on the bottom right angled-edge of one of the extremities of the divided parts of each lead 24. Furthermore, following initial contact the divided lead sections are progressively flattened by further depression of the keytop 28 and in doing so the two gap ends 70 of each lead moves slightly toward one another in scrubbing contact with the conductive pads 16.

In the carrying out of the aforesaid switch action, it is desirable because of the limited amount of force for deflecting the laminates 22 and 26 to remove or etch away as much conductive material from the pattern as possible leaving only enough of such material in the least strained direction (which is the direction of the long axis of each oval opening 20) for reliably performing the conductive function of the pattern. The removal of such material will lower the force needed to flex the diaphragm 22. By also dividing the conductor leads 24 in the center of the oval opening, the diaphragm will be further weakened thus removing the resistance to bending movement of each conductor lead at the midpoint of its span. It is preferred that pattern symmetry be employed in order to produce consistent results. Lastly, the breaks or gaps 66 provided by the division of the conductor leads 24 in the center of each oval zone 20 and the radius of curvature applied to the ends 70 of the leads terminating at the gap will make as high a pressure point contact as possible with its associated conductive pad 16 by bringing the acutely angled end of each divided lead 24 into point contact with the flat surface of the pad. The result is that when the engagement between the contact 16 and 24 first occurs, the high loading point 70 of each divided lead will first make high pressure point contact with the associated pad 16 and then thereafter as further key pressure is applied the terminating ends of the split leads 24 begin to flatten out and at the same time move toward one another with a microscopic scrubbing action on the flat surface of the conductive pad 16.

The electronic keyboard operation can be described as follows. It is evident from the earlier description herein that when the operator pushes on the keytop 28, the force travels through the keytop 28 to the depending members 36. In a desired embodiment of the invention the buckle spring 30 has no load on it when the keytop 28 is fully up but begins compressing it as soon as the keytop 28 starts travel downward. The buckle spring 30 has a spring rate of 7,000 grams per inch for the first 0.03 inches of travel. A negative 2,000 grams per inch for the next 0.015 inches of travel representing the buckling or transition mode, then 750 grams per inch for 0.05 inches of travel, and finally a spring rate of 12,000 grams per inch for the final 0.005 inches of travel where the maximum depression point is reached.

The load from the keytop 28 is transmitted to the top member 10 through the end abutment legs 34 of the buckle spring 30 and does not affect the diaphragm 22 until the spring 30 buckles, at which time, the load is gradually moved towards the rubber pad 26 through the depending rocker members 26. Once proximate to the pad 26 each member 36 then produces a relatively high pressure area on the rubber-like cover or pad 26 and in turn on the diaphragm 22. The load then causes the rubber-like cover 26 and the diaphragm 22 to deflect through its associated pair of oval holes 20 in the dielectric 18 until the conductive leads 24 on the underside of the diaphragm 22 contact conductive elements 16 on the circuit board 14. As the load from the depending members 36 continues to increase, the contact pressure increases accordingly. The bifurcated action together with the teetering capability of the depending members 36 about the sides of the spring 30 overcome any irregularities encountered in making electrical contact between the conductive elements of the assembly.

While a particular embodiment of the invention has been shown and described, it will be understood, of course, that it is not desired that the invention be limited thereto since modifications may be made by those skilled in the art, and it is, therefore, contemplated that the appended claims cover any such modifications as fall within the true spirit and scope of the present invention.

What is claimed is:

1. In a key actuated system for inputting data by the closure of pairs of electrical contacts, and wherein a first of each pair of contacts is carried by a relatively rigid means and a second of each pair of contacts is carried by a flexible diaphragm means spaced from said rigid means, improved key actuating means effective for deflecting said diaphragm means in the direction of said rigid means and for closing each pair of said electrical contacts, said improved key actuating means comprising:

a. means mounted for movement along a path toward and away from said pair of contacts and disposed on the side of said flexible diaphragm means opposite to said rigid means, said movable means including a pair of depending members for contacting said diaphragm means and for activating said second of said pair of contacts carried thereby into closed relationship with said first of said pair of contacts carried by said rigid means, and b. means for yieldably resisting movement of said movable means toward said pair of contacts, said yieldably resisting means comprising spring means disposed in straddled relationship relative to said pair of depending members, said spring means including beam means responsive to a first predetermined pressure by said movable means to effectuate buckling thereof and to thereafter provide less yieldable resistance to the movement of said movable means toward said pair of contacts and to the deflection of said diaphragm means in the direction of said rigid means, said beam means serving to maximally resist movement of said movable means toward said pair of contacts prior to said buckling and to minimally resist the movement of said movable means following said buckling such that the force required to deflect said diaphragm means in the direction of said rigid means and to thereby effectuate closure of said pair of contacts varies between an initial first relatively high level of pressure and a second relatively low level of pressure.

2. The key actuating means defined in claim 1 wherein said spring means additionally includes leg means disposed on either side of said beam means for providing support thereto, and wherein said spring means is provided with a double resistive spring rate including an upper spring rate beyond which said beam means buckles and a lower spring rate that is called into play following said buckling of said beam means and after a tactile commitment to the closure of said pair of electrical contacts has been made.

3. The key actuating means defined in claim 2 wherein the mounting of said movable means for movement along said path toward and away from said pair of contacts is effectuated by means of an aperture formed in a keyboard plate of said key actuated system, said aperture serving to constrain said leg means of said spring means and to define the path of movement of said movable means toward and away from said pair of electrical contacts.

4. The key actuating means defined in claim 1 wherein said beam means includes a convex surface that is transformed into a substantially planar surface upon the application of said first relatively high level of pressure by said movable means, said transformation providing a perceptible tactile and audio indication of the buckling of said beam means and of the closure of said pair of contacts effectuated thereby.

5. The key actuating means defined in claim 1 wherein said movable means further comprises a cam-like surface disposed between the pair of depending members thereof, said cam-like surface being effective for engaging the beam means of the spring means and for redirecting off-center applications of pressure to the movable means such that the application of said first relatively high level of pressure thereto will result in the buckling of the beam means and closure of the pair of electrical contacts.

6. The key actuating means defined in claim 1 wherein said yieldably resisting means further includes resilient means disposed between the spring means and the flexible diaphragm means and in contacting relationship with the flexible diaphragm means and contactable relationship relative to the depending members of said movable means, said resilient means when depressibly contacted by the depending members providing an increased resistance to the movement of the movable means and to the deflection of the diaphragm means so as to dampen the thrust of contact closing produced by the buckling of said beam means and to prevent contact bounce between the pair of electrical contacts upon completing the deflection of the diaphragm means, said resilient means serving also to hermetically seal the pair of electrical contacts from the outside atmosphere.

7. The key actuating means defined in claim 6 wherein said spring means by reason of the buckling of said beam means upon the application of said initial first relatively high level of pressure by said movable means serves to provide a tactile commitment to completing the deflection of said diaphragm means and to the closure of the pair of electrical contacts despite the increased resistance presented by said resilient means.

8. The key actuating means defined in claim 6 wherein said resilient means is a rubber pad.

9. The key actuating means defined in claim 1 wherein the first and second of said pair of contacts each include a pair of spaced apart and parallel circuit areas and wherein said pair of depending members are spaced apart a distance corresponding to the spaced apart distance of said parallel circuit areas such that upon movement of the movable means in the direction of said pair of contacts said depending members contact the parallel circuit areas of the second of said pair of contacts carried by said diaphragm means and activate said contacted parallel circuit areas into contact with the parallel circuit areas of the first of said pair of contacts carried by the rigid means.

10. The key actuating means defined in claim 9 wherein the pair of spaced apart and parallel circuit areas of the second of said pair of contacts are each split into two separate circuit areas of equal length, the innermost ends of said separate circuit areas providing a bifurcated contact with the parallel circuit areas of the first of the pair of contacts as activated by the depending members of the movable means.

11. The key actuating means defined in claim 10 wherein each of the pair of depending members of the movable means is provided with an arcuate configuration such that upon contact with the corresponding parallel circuit areas of the second of the pair of contacts the innermost split ends of the corresponding separate circuit areas are further separated and outwardly and downwardly deflected so as to provide said bifurcated contact with the corresponding parallel circuit areas of the first of said pair of contacts.

12. The key actuating means defined in claim 11 wherein the beam means of the spring means and the cam-like surface of the movable means cooperate during the application of said first and second pressures to thereby enable a lateral teetering of the movable means and depending members while at the same time assuming continuous contact between the parallel circuit areas of the first and second of the pair of contacts.

13. A switch assembly including, in combination:

a. relatively rigid means including a first of a pair of electrical contacts carried on a surface portion thereof;

b. flexible diaphragm means spaced from said rigid means and including a second of said pair of electrical contacts carried on a surface portion thereof, said diaphragm means being deflectable in the direction or the rigid means to effect closure of the pair of electrical contacts;

c. means mounted for movement along a path toward and away from the pair of contacts and disposed on the side of the flexible diaphragm means opposite to the rigid means, said movable means including a pair of depending members for applying pressure to the flexible diaphragm means and to thereby effectuate the closure of the pair of electrical contacts; and d. means for yieldably resisting movement of the movable means toward the rigid means, said yieldably resisting means including spring means disposed above the flexible diaphragm means and intermediate the pair of depending members, said spring means being comprised of leg means and interconnecting beam means that provides a first yieldable resistance to the movement of the movable means and that is qualified for buckling in response to a first predetermined pressure applied by said movable means, said beam means providing a second lesser yieldable resistance to the movement of said movable means following said buckling such that a lesser second predetermined pressure applied by said movable means will serve to continue the deflection of said diaphragm means in the closure of the pair of electrical contacts.

14. The switch assembly defined in claim 13 wherein the mounting of the movable means for movement along said path toward and away from the pair of contacts is effectuated by means of an apertured plate disposed in spaced relationship from said flexible diaphragm means on the side thereof opposite said rigid means, the aperture formed in said plate serving to constrain the leg means of the spring means and to define the path of movement of the movable means toward and away from the pair of electrical contacts.

15. The switch assembly defined in claim 13 wherein said yieldably resisting means further includes resilient means disposed between the spring means and the flexible diaphragm means and in contacting relationship with the flexible diaphragm means and contactable relationship relative to the depending members of said movable means, said resilient means when depressibly contacted by the depending members providing a third yieldable resistance to the movement of the movable means toward the pair of electrical contacts, said third yieldable resistance serving to dampen the thrust of contact closing produced by the buckling of the beam means and to prevent contact bounce between the pair of electrical contacts upon completing the deflection of the diaphragm means, said resilient means serving also to hermetically seal the pair of electrical contacts from the outside atmosphere.

16. The switch assembly defined in claim 15 wherein said spring means by reason of said first yieldable resistance provided by said beam means and the buckling of said beam means upon the application of said first predetermined pressure by said movable means serves to provide a tactile commitment to completing the deflection of said diaphragm means and to the closure of the pair of electrical contacts despite said third yieldable resistance presented by said resilient means.

17. The switch assembly defined in claim 13 wherein said beam means includes a convex surface that bucklingly transforms into a planar configuration upon the application of said first predetermined pressure by said movable means, such transformation providing a perceptible tactile and audio indication that serves to designate the complete deflection of the diaphragm means and closure of the pair of electrical contacts.

18. The switch assembly defined in claim 13 wherein said movable means further comprises a cam-like surface disposed between the pair of depending members thereof, said cam-like surface being effective for engaging the beam means of the spring means and for redirecting off-center applications of pressure to the movable means such that the application of said first predetermined pressure thereto will result in the buckling of the beam means and closure of the pair of electrical contacts.

19. The switch assembly defined in claim 13 wherein said first and said second of said pair of electrical contacts each include a pair of spaced apart and parallel circuit areas and wherein said pair of depending members of said movable means are spaced apart a distance corresponding to the spaced apart distance of said parallel circuit areas such that upon movement of the movable means in the direction of said pair of electrical contacts said depending members contact the parallel circuit areas of the second of said pair of contacts carried by the diaphragm means and activate said contacted parallel circuit areas into contact with the parallel circuit areas of the first of said pair of contacts carried by the rigid means.

20. The switch assembly defined in claim 19 wherein the pair of spaced apart and parallel circuit areas of the second of said pair of electrical contacts are each split into two separate circuit areas of equal length, the innermost ends of said separate circuit areas providing a bifurcated contact as between the parallel circuit areas of the second of the pair of electrical contacts and the parallel circuit areas of the first of the pair of contacts as activated by the depending members of the movable means.

21. The switch assembly defined in claim 20 wherein each of the pair of depending members of the movable means is provided with an arcuate configuration such that upon contact with the corresponding parallel circuit area of the second of the pair of electrical contacts the innermost split ends of the corresponding separate circuit areas are further separated and outwardly and downwardly deflected so as to provide said bifurcated contact with the corresponding parallel circuit area of the first of said pair of electrical contacts.

22. The switch assembly defined in claim 21 wherein the beam means of the spring means and the cam-like surface of the movable means cooperate during the application of said first and second predetermined pressures to thereby enable a lateral teetering of the movable means and depending members while at the same time assuring continuous contact between the parallel circuit areas of the first and second of the pair of electrical contacts.

* * * * *